US005370195A

United States Patent [19]

Keshavan et al.

[11] Patent Number: 5,370,195

[45] Date of Patent: Dec. 6, 1994

[54] DRILL BIT INSERTS ENHANCED WITH POLYCRYSTALLINE DIAMOND

[75] Inventors: Madapusi K. Keshavan, The Woodlands, Tex.; Monte E. Russell, Orem, Utah; Dah-Ben Liang, The Woodlands, Tex.

[73] Assignee: Smith International, Inc., Houston, Tex.

[21] Appl. No.: 123,715

[22] Filed: Sep. 20, 1993

[51] Int. Cl.[5] ..... E21B 10/46

[52] U.S. Cl. ..... 175/420.2; 175/428; 175/426

[58] Field of Search ..... 175/374, 420.1, 420.2, 175/426, 428

[56] References Cited

U.S. PATENT DOCUMENTS

| | | | |
|---|---|---|---|
| 4,171,973 | 10/1979 | Hara et al. | 75/237 |
| 4,231,762 | 11/1980 | Hara et al. | 51/309 |
| 4,370,149 | 1/1983 | Hara et al. | 51/309 |
| 4,525,178 | 6/1985 | Hall | 51/309 |
| 4,604,106 | 8/1986 | Hall et al. | 51/293 |
| 4,694,918 | 9/1987 | Hall | 175/329 |
| 4,811,801 | 3/1989 | Salesky et al. | 175/329 |
| 5,135,061 | 8/1992 | Newton, Jr. | 175/426 X |
| 5,154,245 | 10/1992 | Waldenström et al. | 175/420.2 |
| 5,158,148 | 10/1992 | Keshaven | 175/426 |

*Primary Examiner*—William P. Neuder
*Attorney, Agent, or Firm*—Christie, Parker & Hale

[57] ABSTRACT

A drill bit has means at one end for connecting the bit to a drill string and a plurality of inserts at the other end for crushing the rock to be drilled. The inserts have a cemented tungsten carbide body partially embedded in the drill bit and at least two layers at the protruding drilling portion of the insert. The outermost layer contains polycrystalline diamond and particles of carbide or carbonitride of elements selected from the group consisting of W, Ti, Ta, Cr, Mo, Cb, V, Hf and Zr. The remaining layers adjacent the polycrystalline diamond layer are transition layers each comprising a composite containing diamond crystals, particles of tungsten carbide, and particles of titanium carbonitride. The average size of the diamond particles in the polycrystalline diamond layer is greater than the average size of the carbide or carbonitride particles; and the average size of the diamond particles in the transition layers is greater than the average sizes of the carbide and carbonitride particles. In particular, the transition layers contain particles of carbide and/or carbonitride with average grain sizes of less than one micrometer. The outermost layer of polycrystalline diamond extends along at least a portion of the length of the grip portion of the carbide body embedded in the drill bit.

33 Claims, 3 Drawing Sheets

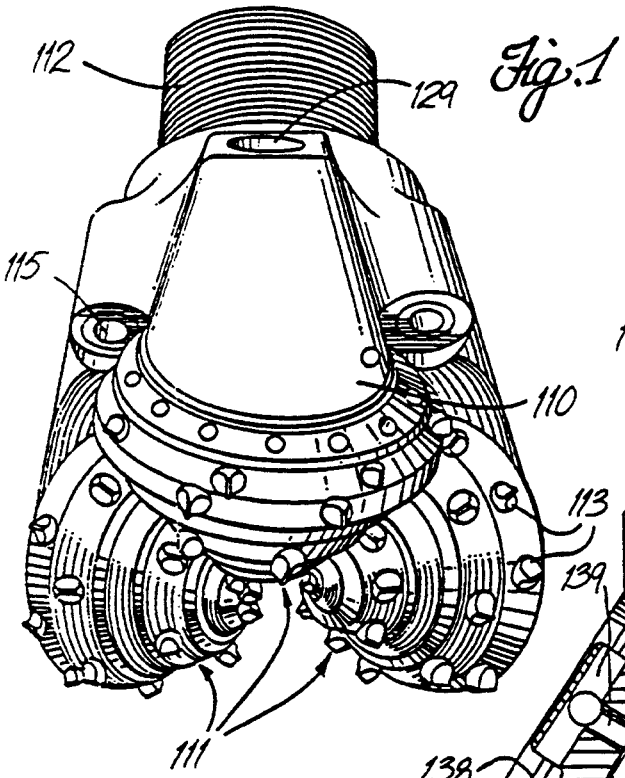
Fig. 1
Fig. 2
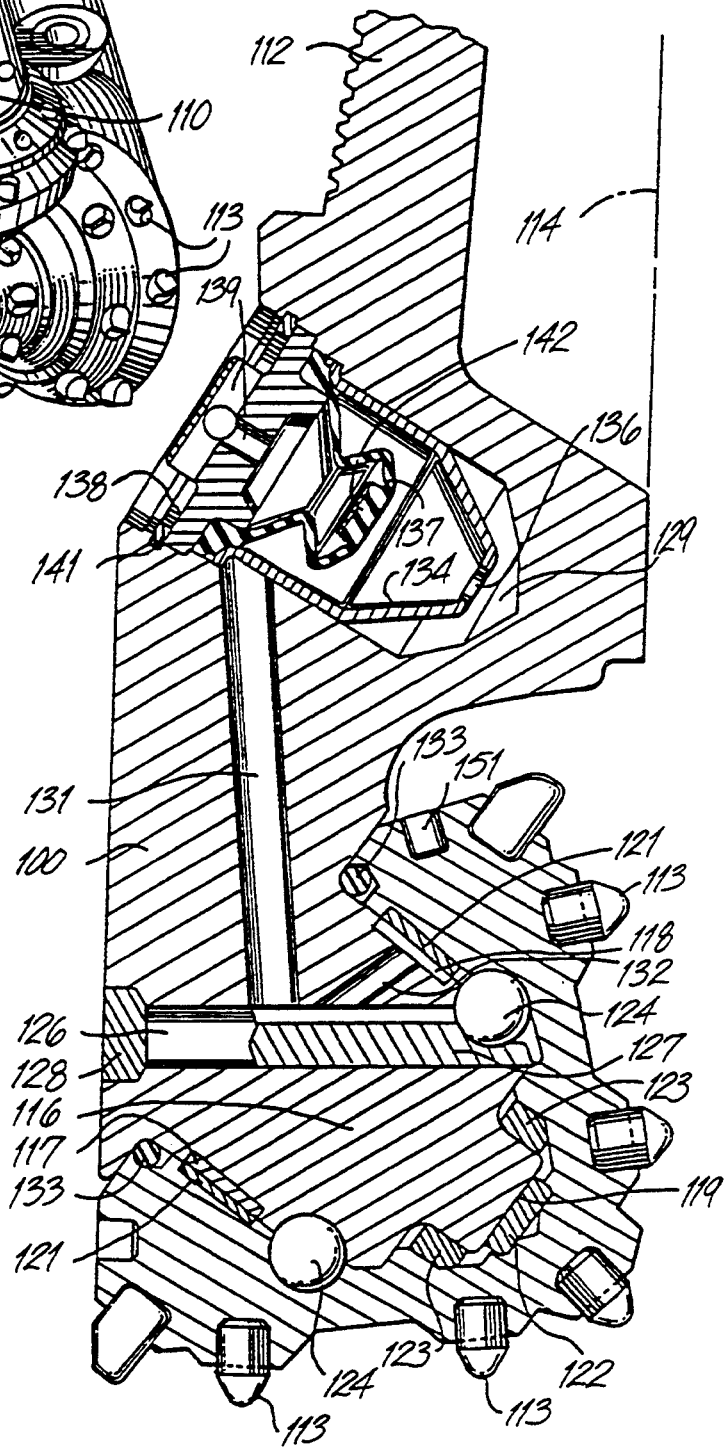

DRILL BIT INSERTS ENHANCED WITH POLYCRYSTALLINE DIAMOND

FIELD OF THE INVENTION

This invention relates to drill bits for drilling blast holes, oil wells, or the like, having polycrystalline diamond tipped inserts for drilling rock formation.

BACKGROUND OF THE INVENTION

Drill bits, including roller cone rock bits and percussion rock bits, are employed for drilling rock, for instance as in drilling wells, or for drilling blastholes for blasting in mines and construction projects. The bits are connected to a drill string at one end and typically have a plurality of cemented tungsten carbide inserts embedded in the other end for drilling rock formations.

Drill bits wear out or fail in such service after drilling many meters of bore hole. The cost of the bits is not considered so much as the cost of the bit, per se, as much as it is considered in the cost of drilling per length of hole drilled. It is considered desirable to drill as much length of bore hole as possible with a given bit before it is used to destruction. It is also important that the gage diameter of the holes being drilled remain reasonably near the desired gage. Thus, wear of the bit that would reduce the hole diameter is undesirable. Further, wear of the inserts in the bit during drilling reduces their protrusion from the surface of the drill bit body. The protrusion has a strong influence on the drilling rate. Thus, as the inserts wear out, the rate of penetration may decrease to the extent that it becomes uneconomical to continue drilling. It is therefore quite desirable to maximize the lifetime of a drill bit in a rock formation, both for reducing bit costs and for maintaining a reasonable rate of penetration of the bit into the rock.

Moreover, when a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the lifetime of a drill bit in a rock formation because prolonging the time of drilling minimizes the lost time in "round tripping" the drill string for replacing bits. Thus, there is a continual effort to upgrade the performance and lengthen the lifetime of those components of a drill bit that are likely to cause a need for replacement.

When a roller cone rock bit is drilling a bore hole, it is important that the diameter or gage of the bore hole be maintained at the desired value. The outermost row of inserts on each cone of a rock bit is known as the gage row. This row of inserts is subjected to the greatest wear since it travels furthest on the bottom of the hole, and the gage row inserts also tend to rub on the side wall of the hole as the cones rotate on the drill bit body. As the gage row inserts wear, the diameter of the bore hole being drilled may decrease below the original gage of the rock bit. When the bit is worn out and removed, a bottom portion of the hole is usually under gage. When the next bit is run in the hole, it is therefore necessary to ream that bottom portion of the hole to bring it to the full desired gage. This not only takes substantial time, but commences wear on the gage row inserts, which again results in an under gage hole as the second bit wears out.

The rate of penetration of a drill bit into the rock formation being drilled is an important parameter for drilling. Clearly it is desirable to maintain a high rate of drilling since this reduces the time required to drill the bore hole, and such time can be costly because of the fixed costs involved in drilling. The rate of penetration decreases when the inserts in the bit become worn and do not protrude from the surface to the same extent they did when drilling commenced. The worn inserts have an increased radius of curvature and increased contact area on the rock. This reduces the rate of penetration.

Thus, it is important to maximize the wear resistance of the inserts in a drill bit to maintain a high rate of penetration as long as possible. It is particularly important to minimize wear of the gage row inserts to maximize the length of hole drilled to full gage.

A significant improvement in the life expectancy of drill bits, including roller cone and percussion rock bits, involves the use of cemented metal carbide inserts put into the drill bit for crushing rock on the bottom of the bore hole. Naturally, cemented metal carbide, such as cobalt cemented tungsten carbide, offered improved wear resistance over steel along with sufficient toughness to withstand the forces encountered during drilling. Since the advent of cemented metal carbide inserts in rock drilling, much effort has been devoted to improving both the wear resistance and toughness of the inserts. Wear resistance is important to prevent the insert from simply wearing away during drilling. Toughness is important to avoid inserts breaking off due to the high impact loads experienced in drilling.

A more recent development in drill bit inserts has been the use of a layer of polycrystalline diamond (PCD). In particular, "enhanced" inserts, as they are called, have been fabricated which include an insert body made of cobalt bonded tungsten carbide and a layer of polycrystalline diamond directly bonded to the protruding head portion of the insert body. The term polycrystalline diamond generally refers to the material produced by subjecting individual diamond crystals to sufficiently high pressure and high temperature that intercrystalline bonding occurs between adjacent diamond crystals. Naturally, PCD offers the advantage of greater wear resistance. However, because PCD is relatively brittle, some problems have been encountered due to chipping or cracking in the PCD layer.

U.S. Pat. No. 4,694,918 discloses roller cone rock bits and inserts therefor, which inserts include a cemented metal carbide insert body, an outer layer of polycrystalline diamond, and at least one transition layer of a composite material. The composite material includes polycrystalline diamond and particles of precemented metal carbide. Although this transition layer between the outer layer of PCD and the head portion has been found to extend the life expectancy of PCD rock bit inserts by reducing the incidence of cracking and chipping, the current enhanced inserts still are not optimum for drilling rock formation with high compressive strength. Although the PCD layer is extremely hard and therefore resistant to wear, the typical mode of failure is cracking of the PCD layer due to high contact stress, lack of toughness, and insufficient fatigue strength. A crack in the PCD layer during drilling will cause the PCD layer to spall, or delaminate, exposing the head portion of the insert to significantly increased wear. A crack in the PCD layer may propogate through the cemented tungsten carbide body of the insert and cause complete failure of the insert. It is therefore desirable to provide inserts that are not only hard, to resist wear, but also tough enough and strong enough to drill through rock formation with high compressive strength without breakage or delamination of the PCD layer.

BRIEF SUMMARY OF THE INVENTION

There is, therefore, provided in practice of this invention according to a presently preferred embodiment, a drill bit having means at one end for connecting the bit to a drill string and a plurality of inserts at the other end for crushing the rock to be drilled. At least some of those inserts comprise a cemented tungsten carbide body having a grip portion embedded in the drill bit and a converging head portion protruding from the surface of the drill bit.

The insert comprises at least one of the following: an outer layer on the head portion of the carbide body comprising a composite containing polycrystalline diamond and particles of carbides or carbonitrides of elements selected from the group consisting of W, Ti, Ta, Cr, Mo, Cb, V, Hf, Zr and mixtures thereof; a transition layer comprising a composite containing diamond crystals, particles of tungsten carbide, and particles of titanium carbonitride; an outer layer on the head portion containing polycrystalline diamond and particles of carbide or carbonitride where the average size of the diamond particles is greater than the average size of the carbide or carbonitride particles; a transition layer comprising a composite containing diamond crystals, particles of tungsten carbide, and particles of titanium carbonitride where the average size of the diamond particles is greater than the average sizes of the carbide and carbonitride particles; and/or a transition layer containing particles of carbide and/or carbonitride with average grain sizes of less than one micrometer; an outer layer of polycrystalline diamond material extending along at least a portion of the length of the grip portion of the carbide body.

BRIEF DESCRIPTION OF THE DRAWINGS

FIG. 1 illustrates in semi-schematic perspective an exemplary roller cone drill bit;

FIG. 2 is a partial longitudinal cross-section of such a drill bit;

DETAILED DESCRIPTION

Figure 3:
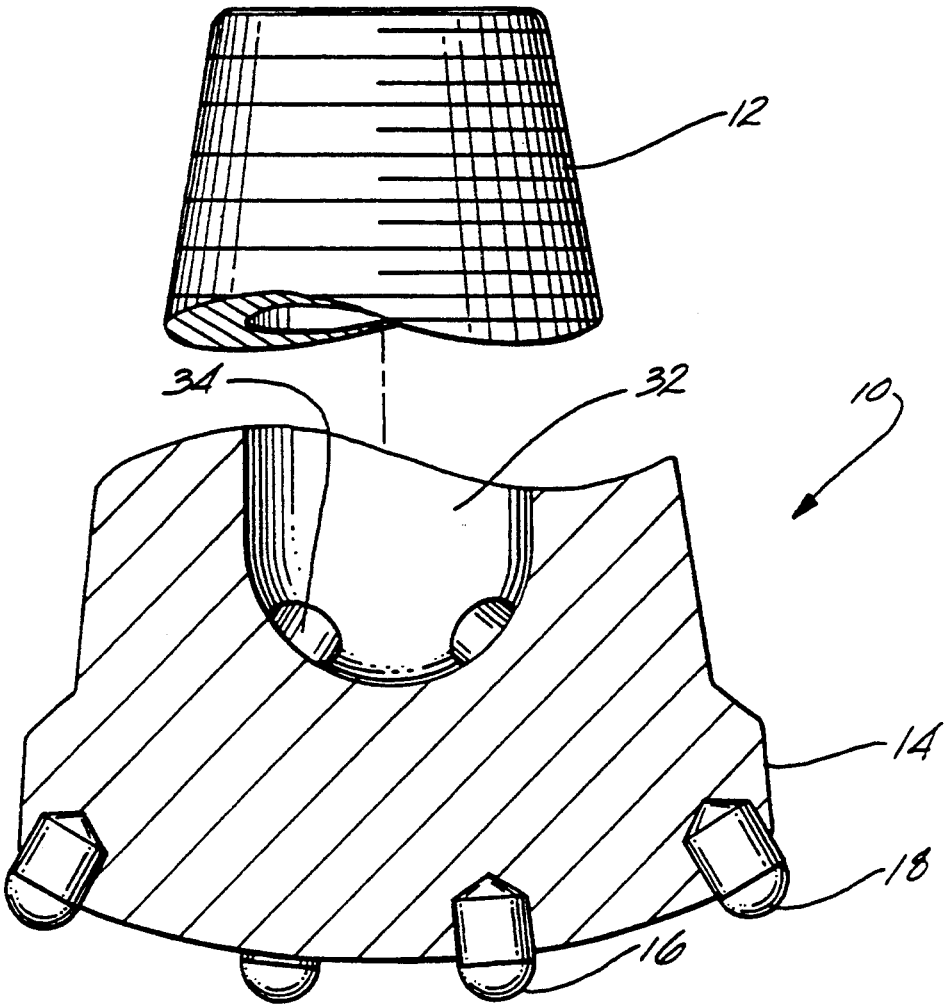
FIG. 3 is a fragmentary longitudinal cross-section of an exemplary percussion drill bit.

As used in this specification, the term polycrystalline diamond, along with its abbreviation "PCD," refers to the material produced by subjecting individual diamond crystals to sufficiently high pressure and high temperature that intercrystalline bonding occurs between adjacent diamond crystals. Exemplary minimum temperature is about 1200° C. and an exemplary minimum pressure is about 35 kilobars. Typical processing is at a pressure of about 45 kbar and 1300° C. The minimum sufficient temperature and pressure in a given embodiment may depend on other parameters such as the presence of a catalytic material, such as cobalt, with the diamond crystals. Generally such a catalyst/binder material is used to assure intercrystalline bonding at a selected time, temperature and pressure of processing. As used herein, PCD refers to the polycrystalline diamond including residual cobalt. Sometimes PCD is referred to in the art as "sintered diamond."

FIG. 1 illustrates in semi-schematic perspective an exemplary roller cone drill bit. The bit comprises a steel body 110 having three cutter cones 111 mounted on its lower end. A threaded pin 112 is at the upper end of the body for assembly of the drill bit onto a drill string for drilling oil wells or the like. A plurality of tungsten carbide inserts 113 are provided in the surfaces of the cutter cones for bearing on rock formation being drilled.

FIG. 2 is a fragmentary longitudinal cross-section of the rock bit extending radially from the rotational axis 114 of the rock bit through one of the three legs on which the cutter cones 111 are mounted. Each leg includes a journal pin 116 extending downwardly and radially inwardly of the rock bit body. The journal pin includes a cylindrical bearing surface having a hard metal insert 117 on a lower portion of the journal pin. The hard metal insert is typically a cobalt or iron base alloy welded in place in a groove on the journal leg and having a substantially greater hardness than the steel forming the journal pin and rock bit body. An open groove 118 corresponding to the insert 117 is provided on the upper portion of the journal pin. Such a groove can, for example, extend around 60% or so of the circumference of the journal pin and the hard metal 117 can extend around the remaining 40% or so. The journal pin also has a cylindrical nose 119 at its lower end.

Each cutter cone 111 is in the form of a hollow, generally conical steel body having tungsten carbide inserts 113 pressed into holes on the external surface. The outer row of inserts 120 on each cone is referred to as the gage row since these inserts drill at the gage or outer diameter of the bore hole. Such tungsten carbide inserts provide the drilling action by engaging and crushing subterranean rock formation on the bottom of a bore hole being drilled as the rock bit is rotated. The cavity in the cone contains a cylindrical bearing surface including an aluminum bronze or spinodal copper alloy insert 121 deposited in a groove in the steel of the cone or as a floating insert in a groove in the cone. The bearing metal insert 121 in the cone engages the hard metal insert 117 on the leg and provides the main bearing surface for the cone on the bit body. A nose button 122 is between the end of the cavity in the cone and the nose 119, and carries the principal thrust loads of the cone on the journal pin. A bushing 123 surrounds the nose and provides additional bearing surface between the cone and journal pin.

A plurality of bearing balls 124 are fitted into complementary ball races in the cone and on the journal pin. These balls are inserted through a ball passage 126 which extends through the journal pin between the bearing races and the exterior of the rock bit. A cone is first fitted on a journal pin and then the bearing balls 124 are inserted through the ball passage. The balls carry any thrust loads tending to remove the cone from the journal pin and thereby retain the cone on the journal pin. The balls are retained in the races by a ball retainer 127 inserted through the ball passage 126 after the balls are in place. A plug 128 is then welded into the end of the ball passage to keep the ball retainer in place.

The bearing surfaces between the journal pin and the cone are lubricated by a grease which fills the regions adjacent the bearing surfaces plus various passages and a grease reservoir. The grease reservoir comprises a cavity 129 in the rock bit body which is connected to the ball passage 126 by a lubricant passage 131. Grease also fills the portion of the ball passage adjacent the ball retainer, the open groove 118 on the upper side of the journal pin and a diagonally extending passage 132 therebetween. Grease is retained in the bearing structure by a resilient seal in the form of an O-ring 133 between the cone and journal pin.

A pressure compensation subassembly is included in the grease reservoir 129. This subassembly comprises a metal cup 134 with an opening 136 at its inner end. A flexible rubber bellows 137 extends into the cup from its outer end. The bellows is held in place by a cap 138 having a vent passage 139 therethrough. The pressure compensation subassembly is held in the grease reservoir by a snap ring 141.

The bellows has a boss 142 at its inner end which can seat against the cap 138 at one end of the displacement of the bellows for sealing the vent passage 139. The end of the bellows can also seat against the cup 134 at the other end of its stroke, thereby sealing the opening 136.

FIG. 3 is a fragmentary longitudinal cross-section of an exemplary percussion rock bit. The bit comprises a hollow steel body 10 having a threaded pin 12 at the upper end of the body for assembly of the rock bit onto a drill string for drilling oil wells or the like. The body includes a cavity 32 and holes 34 communicating between the cavity and the surface of the body. The holes divert the air pumped through the bit by the air hammer out of the cavity into the bore hole to provide cooling and remove rock chips from the hole.

The lower end of the body terminates in a head 14. The head is enlarged relative to the body 10 and is somewhat rounded in shape. A plurality of inserts 16 are provided in the surface of the head for bearing on the rock formation being drilled. The inserts provide the drilling action by engaging and crushing subterranean rock formation on the bottom of a bore hole being drilled as the rock bit strikes the rock in a percussive motion. The outer row of inserts 18 on the head is referred to as the gage row since these inserts drill the gage or outer diameter of the bore hole.

Figure 4:
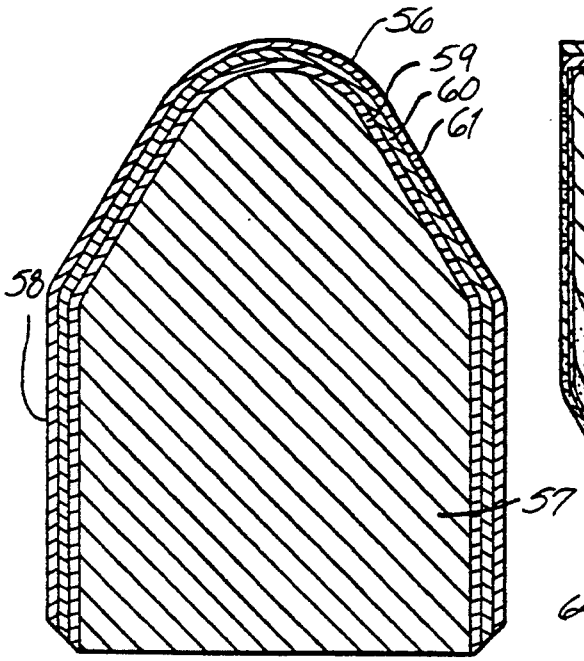
FIG. 4 is a longitudinal cross-section of an exemplary drill bit insert.

In practice of this invention at least a portion of the cutting structure of the drill bit, which refers to both roller cone rock bits and percussion rock bits, comprises tungsten carbide inserts that are tipped with polycrystalline diamond. An exemplary insert is illustrated in longitudinal cross-section in FIG. 4. Such an insert comprises a cemented tungsten carbide body 57 having a cylindrical grip length 58 extending along a major portion of the insert. At one end there is a converging portion, or head portion, 56 which may have any of a variety of shapes depending on the desired cutting structure. The head portion may be referred to as a projectile shape, basically a cone with a rounded end. It may be a chisel shape, which is like a cone with converging flats cut on opposite sides and a rounded end. The head portion may be hemispherical, or any of a variety of other shapes known in the art.

Typically the inserts are embedded in the drill bit by press fitting or brazing into the bit. The bit has a plurality of holes on its outer surface. An exemplary hole has a diameter about 0.13 mm smaller than the diameter of the grip 58 of an exemplary insert. The insert is pressed into the hole in the steel head of the bit with many thousand kilograms of force. This press fit of the insert into the bit tightly secures the insert in place and prevents it from being dislodged during drilling.

The head portion 56 of the exemplary insert includes an outer layer 61 for engaging rock and two transition layers, an outer transition layer 60 and an inner transition layer 59, between the outer layer 61 and the cemented tungsten carbide body 57 of the insert. While the currently preferred embodiment comprises two distinct transition layers, any number of transition layers can be used. Moreover, in the exemplary embodiment, the outer layer 61 extends along at least a portion of the grip length 58 of the body 57 of the insert, preferably along the entire grip length. One or more transition layers may also extend along a portion of the grip length. Because the diamond in the PCD and transition layers has a lower coefficient of thermal expansion than the carbide, a residual compressive force remains on the surface of the portion of the grip length coated by the PCD layer and any transition layers after sintering of the layers (as described below). The residual compression increases the resistance of the insert to breakage.

The outer layer 61 comprises a composite containing polycrystalline diamond and particles of carbide or carbonitride of elements selected from the group consisting of W, Ti, Ta, Cr, Mo, Cb, V, Hf, Zr and mixtures thereof. In an exemplary embodiment, the outer PCD layer 61 comprises a composite containing 90% by volume diamond crystals, 7.5% by volume cobalt and 2.5% by volume particles of carbides or carbonitrides of elements selected from the group consisting of W, Ti, Ta, Cr, Mo, Cb, V, Hf, Zr and mixtures thereof. The PCD layer may contain up to 8% by volume carbide or carbonitride, preferably less than 5% by volume. A particularly preferred composition has about two to three percent by volume of the carbide or carbonitride.

The average size of the carbide or carbonitride particles in the PCD layer is preferably less than one micrometer. In addition, the average size of the diamond particles in the PCD layer is greater than the average size of the carbide or carbonitride particles in the PCD layer. In an exemplary embodiment, the PCD layer contains diamond crystals with sizes ranging from one to twenty micrometers. A diamond crystal size in the range of from four to eight micrometers is preferred. The differential in size between the diamond crystals and the carbide or carbonitride particles allows the carbide or carbonitride particles to fill in spaces between adjacent diamond crystals so that the PCD layer is more tightly packed, and therefore tougher, than the PCD layers of conventional enhanced inserts. In one embodiment diamond particle sizes in the range of from four to eight micrometers and titanium carbonitride particles in the range of from two to six micrometers has been satisfactory. It is preferred, however, to employ carbide or carbonitride particles in the range of from one half to one micrometer.

Moreover, the carbide or carbonitride provides a source of carbon that dissolves in the cobalt at the high temperatures involved in sintering the PCD layer (as described below) and precipitates out of solution as diamond at lower temperatures. Thus, the cobalt acts as a transport medium as carbon is transferred from carbide or carbonitride to diamond. As the carbon precipitates out of solution as diamond, it bonds to the diamond particles already present and strengthens the bonding of adjacent diamond crystals. Thus, the addition of carbide or carbonitride provides a PCD layer that is tougher than the PCD layers of conventional enhanced inserts.

The enhanced properties of the PCD inhibit cracking and spalling of the layers.

The transition layers 60 and 59 each comprise a composite containing diamond crystals, cobalt, particles of tungsten carbide and particles of titanium carbonitride. An exemplary outer transition layer 60 comprises a composite containing approximately 57% by volume diamond crystals, 11% by volume cobalt particles, 32% by volume particles of tungsten carbide. In addition, the layer comprises up to 8% by volume titanium carbonitride, generally as a substitute for part of the tungsten carbide. An exemplary inner transition layer 59 comprises a composite containing approximately 38% by volume diamond crystals, 14% by volume cobalt particles, 48% by volume particles of tungsten carbide and up to 8% by volume titanium carbonitride, substituting for other materials in the transition layer. Preferably, the transition layers each comprise less than five percent by volume titanium carbonitride. In an exemplary embodiment, the transition layers each contain between 2.5 and 3% by volume titanium carbonitride.

In the practice of this invention, particles of other refractory carbonitrides may be used instead of titanium carbonitride particles in the transition layers. For example, one may use a complex tungsten-titanium carbonitride or a niobium carbonitride, which are also commercially available. The average sizes of the carbide and carbonitride particles in the transition layers are preferably less than one micrometer. In addition, the average size of the diamond particles contained in any given layer is greater than the average sizes of the carbide and carbonitride particles contained in such layer. In the exemplary embodiment, the transition layers contain diamond crystals with sizes in the range of one to twenty micrometers. A diamond crystal size of from four to eight micrometers is preferred. As described above regarding the PCD layer, the size differential between the diamond crystals and the carbide and carbonitride particles strengthens the transition layers, as does the addition of titanium carbonitride. Titanium carbonitride is preferred because it readily dissolves in the cobalt.

The tungsten carbide in the transition layers preferably has a particle size less than five micrometers, and most preferably a particle size in the range of from one half to one micrometer. The tungsten carbide used in the transition layers may be precemented carbide, crushed substoichiometric WC (i.e., a composition somewhere between WC and $W_2C$), a cast and crushed alloy of tungsten carbide and cobalt or a plasma sprayed alloy of tungsten carbide and cobalt. Regardless, it is preferred that the particle size of the carbide be less than the particle size of the diamond.

Preferably, the catalyst metal employed in forming the PCD layer and any transition layers is cobalt, and preferably the catalyst metal is present in the range from 13 to 30% by weight in any given layer. Seventeen percent by weight catalyst metal is preferred. In some embodiments, other catalyst metals, including metals selected from the group consisting of iron and nickel, may be used.

The exemplary cemented tungsten carbide body 57 of the insert comprises 406 grade tungsten carbide (average four micrometer tungsten carbide particles; 6% by weight cobalt content). In another embodiment, the carbide body comprises 411 grade tungsten carbide (average four micrometer tungsten carbide particles; 11% by weight cobalt content).

The composite material of the outer PCD layer and each transition layer is made separately as described below. The procedure is the same for each layer; the only variation is in the relative proportions of diamond crystals, cobalt powders and particles of carbide and/or carbonitride used in each layer.

The raw materials for making each layer are preferably milled together in a ball mill with acetone. Milling in a ball mill lined with cemented tungsten carbide and using cemented tungsten carbide balls is preferred to avoid contamination of the diamond. An attritor or planetary mill may be used if desired. A minimum of one hour of ball milling is preferred. The mixture is then dried and reduced in hydrogen at 700° C. for at least 24 hours. The very small size tungsten carbide or tungsten carbide-cobalt particles used in forming the layers may be obtained from Nanodyne Incorporated located in New Brunswick, N.J.

Figure 5:
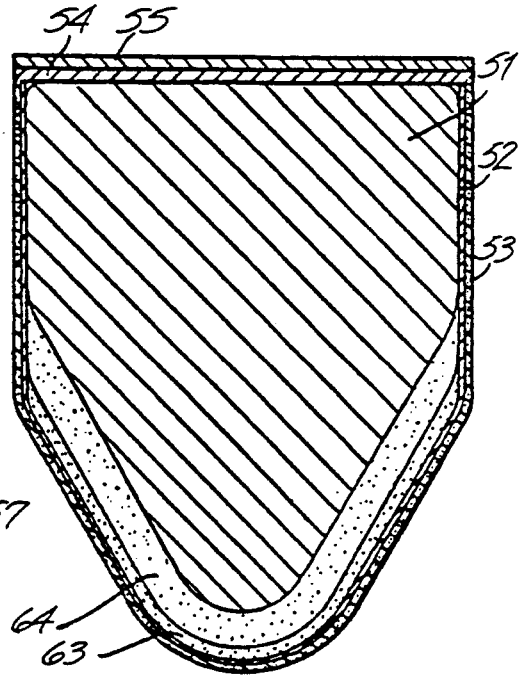
FIG. 5 is a longitudinal cross-section of a subassembly for forming such a drill bit insert.

The blended and reduced powders for making the layers of the insert are coated with wax, sintered and bonded to a drill bit insert blank 51 in an assembly of the type illustrated in FIG. 5. The insert blank 51 comprises a cylindrical cemented tungsten carbide body having a converging portion at one end. The converging portion has the geometry of the completed insert, less the thickness of the layers to be formed thereon. The assembly is formed in a deep drawn metal cup which preferably has double walls. There is an inner cup 52, the inside of which is formed to the desired net shape of the end of the rock bit insert to be preformed. The inner cup is zirconium sheet having a thickness of 50 to 125 micrometers. The outer cup 53 is molybdenum with a thickness of 250 micrometers. The zirconium sheet 54 and molybdenum sheet 55 close the assembly at the top. The zirconium "can" thus formed protects material within it from the effects of nitrogen and oxygen. The molybdenum "can" protects the zirconium from water which is often present during the high pressure, high temperature pressing cycle used to form the rock bit insert.

To make such an assembly as illustrated in FIG. 5, the reduced powder which has been coated with wax may be placed in the cup and spread into a thin layer by pressing with an object having the same shape as the insert blank when the blank is axisymmetric. If desired, the insert blank can be used to spread the wax-coated powder mixture. Powder to make the outer layer is spread first, then powder to make the first transition layer is added and spread on the outer layer. Additional transition layers are formed in the same manner. Finally, the insert blank is put in place and the metal sheets are added to close the top of the assembly. Alternatively, layers can be built up on the end of the insert blank before insertion into the cup. For example, sufficient wax may be included with the powders to form self-supporting "caps" of blended powder to be placed on the insert blank or in the cups.

In another embodiment, the blended powders for making the layers on the insert are embedded in a plastically deformable tape material. The services of a company such as Ragan Technologies, a division of Wallace Technical Ceramics, San Diego, Calif. may be employed for forming the blended powders into the desired tape material. The raw materials for making each layer, including a temporary binder, are mixed with water by traditional means. The blended material is then dried and made into a powder. The dry powder is fed into a tape forming machine where tape preforming rolls convert the powder mixture to tape form. A conveyor drying oven provides optimum temperatures and air circulation for the removal of water vapor and subsequently provides a zone for cooling of the tape. Finishing rolls perform a densification function, impart surface finish to the tape, and set the final thickness of the tape. Plastically deformable tape incorporating diamond, carbide, etc. powders may also be fabricated by Advanced Refractory Technologies, Inc. of Buffalo, N.Y.

The tape material for each layer containing the desired proportions of diamond, cobalt and carbide and/or carbonitride particles is cut and put into a punch and die apparatus for shaping the tape material to match the shape of the converging head portion of the completed insert. Each layer is placed on top of the insert in respective order and a zirconium "can" as described above is placed over the insert. When the layers are included on the grip portion of the insert, one or more layers of the tape may be wrapped around the insert. The binder contained in the tape is removed by heating the insert and zirconium "can" in vacuum at 650° C.

One or more of such assemblies formed from the above alternative embodiments is then placed in a conventional high-pressure cell for pressing in a belt press or cubic press. A variety of known cell configurations are suitable. An exemplary cell has a graphite heater surrounding such an assembly and insulated from it by salt or pyrophyllite for sealing the cell and transmitting pressure. Such a cell, including one or more such assemblies for forming a drill bit insert, is placed in a high pressure belt or cubic press and sufficient pressure is applied that diamond is thermodynamically stable at the temperatures involved in the sintering process. In an exemplary embodiment, a pressure of 50 kilobars is used.

As soon as the assembly is at high pressure, current is passed through the graphite heater tube to raise the temperature of the assembly to at least 1300° C., and preferably to between 1350° to 1400° C. When the assembly has been at high temperature for a sufficient period for sintering and formation of polycrystalline diamond, the current is turned off and the parts rapidly cooled by heat transfer to the water cooled anvils of the press. An exemplary run time in the press is eleven minutes. When the temperature is below 700° C., and preferably below 200° C., pressure can be released so that the cell and its contents can be ejected from the press. The metal cans and any other adhering material can be readily removed from the completed insert by sandblasting or etching. The grip of the completed insert may be diamond ground to a cylinder of the desired size for fitting in a hole in the drill bit. The composite layers of diamond crystals and particles of carbide and/or carbonitride are, of course, sintered by the high temperature and pressure and are no longer in the form of discrete particles that could be separated from each other. In addition, the layers sinter to each other.

The PCD layers of the inserts thus formed are tough enough and hard enough optimally to drill rock formation with high compressive strength without cracking or spalling of the PCD layer. The PCD tipped inserts may be used for all of the cutting structure of the drill bit, including the gage row inserts.

Laboratory tests have been run comparing these new enhanced inserts with enhanced inserts having prior PCD and transition layers, and with conventional cemented tungsten carbide inserts (11% cobalt grade). The tested inserts were 9/16 inch (1.43 cm) diameter hemispherical inserts. Fatigue tests employed an acoustic emission sensor for detecting cracks where an anvil engaged the PCD layer on the insert at a 45° angle with respect to the axis of the insert. Compressive load was varied between 100 and 10,000 pounds (45 to 4500 Kg) and the number of cycles to failure was recorded. Fatigue strength is comparable to a standard tungsten carbide insert without a PCD layer, and about 30 to 50% better than a prior enhanced insert.

Impact strength was tested in a drop tower. After a single impact loading, the PCD surface of the insert was checked for cracks. Whereas the impact strength of a prior enhanced insert is somewhat less than a corresponding tungsten carbide insert, the new insert has an impact strength about 30 to 50% greater than a conventional tungsten carbide insert. Compressive stength of the new enhanced insert is also about 25 to 30% greater than a conventional tungsten carbide insert.

Field tests of a rotary percussion or hammer bit have been performed in a mine at Royal Oak, Canada. The rock being drilled has a compressive strength of about 45,000 psi (3150 kg/cm). With previous conventional cemented tungsten carbide inserts such a bit could drill only about 30 to 40 feet (9 to 12 m.), even with one resharpening. Prior enhnanced inserts with a PCD layer and transition layers were not satisfactory in this high compressive strength rock since breakage occurred too often. New enhanced inserts as described herein were placed on the gage of the bits, that is, the row of inserts that drills adjacent to the wall of the hole. Such bits drill satisfactorily from 200 to 450 feet (60 to 135 m.) without significant insert breakage or wear.

Persons skilled in the art and technology to which this invention pertains will readily discern that the preceding description has been presented with reference to the currently preferred embodiment of the invention and that variations can be made in the embodiments without departing from the essence and scope of the invention.

In addition, one skilled in the relevant art will discern that the disclosed inserts may be useful as the cutting structure of digging, sawing or drilling apparatus other than drill bits. For instance, the inserts may be used in mining picks or the like. In such an embodiment, one insert is mounted in each steel pick and a number of picks are mound on a wheel or chain for cutting rock formation.

What is claimed is:

1. A drill bit, comprising:

a steel body;

means at one end of the steel body for connecting the bit to a drill string; and a plurality of inserts embedded within the bit, at least a portion of the inserts comprising:

a cemented tungsten carbide body having a grip portion embedded in the bit and a head portion protruding from the surface of the bit;

a layer of polycrystalline diamond material on the head portion of the carbide body, the polycrystalline diamond layer comprising a composite containing polycrystalline diamond and particles of carbide or carbonitride of elements selected from the group consisting of W, Ti, Ta, Cr, Mo, Cb, V, Hf, Zr and mixtures thereof; and at least one transition layer between the polycrystalline diamond layer and the carbide body, such a transition layer comprising a composite containing diamond crystals and tungsten carbide particles.

2. The drill bit of claim 1 wherein at least one transition layer comprises a composite containing diamond crystals, tungsten carbide particles and particles of refractory carbonitride.

3. The drill bit of claim 2 wherein at least one transition layer contains up to eight percent by volume titanium carbonitride.

4. The drill bit of claim 2 wherein the average size of the diamond particles contained in the polycrystalline diamond layer is greater than the average size of the carbide or carbonitride particles in the polycrystalline diamond layer, and the average size of the diamond particles contained in at least one transition layer is greater than the average sizes of the carbide and carbonitride particles contained in such transition layer.

5. The drill bit of claim 1 wherein the layer of polycrystalline diamond material extends along at least a portion of the length of the grip portion of the carbide body of the insert.

6. The drill bit of claim 5 wherein at least one transition layer extends along at least a portion of the length of the grip portion of the carbide body of the insert.

7. The drill bit of claim 1 wherein the polycrystalline diamond layer contains up to eight percent by volume carbide or carbonitride.

8. The drill bit of claim 1 wherein the average size of the diamond particles contained in the polycrystalline diamond layer is greater than the average size of the carbide or carbonitride particles contained in the polycrystalline diamond layer.

9. The drill bit of claim 8 wherein the carbide or carbonitride contained in the polycrystalline diamond layer, and the carbide contained in at least one transition layer comprises a powder with an average grain size of less than one micrometer and a metal binder selected from the group consisting of cobalt, iron and nickel.

10. The drill bit of claim 1 wherein the drill bit is a roller cone rock bit.

11. The drill bit of claim 1 wherein the drill bit is a percussion rock bit.

12. A drill bit, comprising:

a steel body;

means at one end of the steel body for connecting the bit to a drill string; and a plurality of inserts embedded within the bit, at least a portion of the inserts comprising:

a cemented tungsten carbide body having a grip portion embedded in the bit and a head portion protruding from the surface of the bit;

a layer of polycrystalline diamond material on the head portion of the carbide body; and at least one transition layer between the polycrystalline diamond layer and the carbide body, such a transition layer comprising a composite containing diamond crystals and particles of tungsten carbide, and wherein the average size of the diamond particles is greater than the average size of the carbide particles.

13. The drill bit of claim 14 wherein the carbide contained in at least one transition layer comprises a carbide powder with an average grain size of less than one micrometer and a metal binder selected from the group consisting of cobalt, iron and nickel.

14. A drill bit comprising:

a steel body;

means at one end of the steel body for connecting the bit to a drill string; and a plurality of inserts embedded within the bit, at least a portion of the inserts comprising:

a cemented tungsten carbide body having a grip portion embedded in the bit and a head portion protruding from the surface of the bit; and a layer of polycrystalline diamond material on the head portion and extending along at least a portion of the length of the grip portion of the carbide body.

15. The drill bit of claim 14 wherein at least one transition layer extends along at least a portion of the length of the grip portion of the carbide body of the insert.

16. An insert for use in drilling apparatus, comprising:

a cemented tungsten carbide body having a grip portion embedded in the drilling apparatus and a head portion protruding from the surface of the drilling apparatus;

a layer of polycrystalline diamond material on the head portion of the carbide body, such a polycrystalline diamond layer comprising a composite containing polycrystalline diamond and particles of carbides or carbonitrides of elements selected from the group consisting of W, Ti, Ta, Cr, Mo, Cb, V, Hf, Zr and mixtures thereof; and at least one transition layer between the polycrystalline diamond layer and the carbide body, such a transition layer comprising a composite containing diamond crystals and tungsten carbide particles.

17. The insert of claim 16 wherein at least one transition layer comprises a composite containing diamond crystals, tungsten carbide particles and particles of refractory carbonitride.

18. The insert of claim 17 wherein at least one transition layer contains up to eight percent by volume titanium carbonitride.

19. The insert of claim 17 wherein the average size of the diamond particles contained in the polycrystalline diamond layer is greater than the average size of the carbide or carbonitride particles in the polycrystalline diamond layer, and the average size of the diamond particles contained in at least one transition layer is greater than the average sizes of the carbide and carbonitride particles contained in the transition layer.

20. The insert of claim 16 wherein the polycrystalline diamond layer contains up to eight percent by volume carbide or carbonitride.

21. The insert of claim 16 wherein the average size of the diamond particles contained in the polycrystalline diamond layer is greater than the average size of the carbide or carbonitride particles contained in the polycrystalline diamond layer, and the average size of the diamond particles in at least one transition layers is greater than the average size of the carbide particles in such transition layer.

22. The insert of claim 21 wherein the carbide or carbonitride contained in the polycrystalline diamond layer, and the carbide contained in at least one transition layer comprises a powder with an average grain size of less than one micrometer and a metal binder selected from the group consisting of cobalt, iron and nickel.

23. The insert of claim 16 wherein the layer of polycrystalline diamond material extends along at least a portion of the length of the grip portion of the carbide body.

24. An insert for use in drilling apparatus, comprising:

a cemented tungsten carbide body having a grip portion embedded in the drilling apparatus and a head portion protruding from the surface of the drilling apparatus;

a layer of polycrystalline diamond material on the head portion of the carbide body; and at least one transition layer between the polycrystalline diamond layer and the carbide body, such a transition layer comprising a composite containing diamond crystals and tungsten carbide particles, and wherein the average size of the diamond particles is greater than the average size of the carbide particles.

25. The insert of claim 24 wherein the carbide contained in at least one transition layer comprises a carbide powder with an average grain size of less than one micrometer and a metal binder selected from the group consisting of cobalt, iron and nickel.

26. The insert of claim 24 wherein the layer of polycrystalline diamond material extends along at least a portion of the length of the grip portion of the carbide body.

27. The insert of claim 26 wherein at least one transition layer extends along at least a portion of the length of the grip portion of the carbide body.

28. An insert for use in drilling apparatus comprising:

a cemented tungsten carbide body having an embedded grip portion and a protruding head portion; and a polycrystalline diamond layer on at least the head portion, the polycrystalline diamond layer comprising a composite material containing polycrystalline diamond and particles of a material selected from the group consisting of tungsten carbide and titanium carbonitride, the particles having a size less than the size of the diamond crystals.

29. An insert as recited in claim 28 wherein the proportion of particles is less than eight percent by volume of the polycrystalline diamond layer.

30. An insert as recited in claim 28 wherein the proportion of particles is in the range of from two to three percent by volume of the polycrystalline diamond layer.

31. An insert as recited in claim 28 wherein the particles comprise titanium carbonitride.

32. An insert as recited in claim 28 further comprising at least one transition layer between the polycrystalline diamond layer and the tungsten carbide body, the transition layer comprising a composite material of diamond, tungsten carbide and cobalt phases.

33. An insert as recited in claim 32 wherein the tungsten carbide particles in the transition layer have a particle size smaller than the particle size of the diamond crystals.

* * * * *